US007037104B2

(12) United States Patent
Azzinaro et al.

(10) Patent No.: US 7,037,104 B2
(45) Date of Patent: May 2, 2006

(54) DEVICE AND METHOD FOR EXPOSING A CANDLE WICK EMBEDDED IN CANDLE WAX

(76) Inventors: Mary Katherine Azzinaro, 9522 Cherokee Ave., Las Vegas, NV (US) 89147; Kasey Virgil Dutt, 7045 Lanewood Ave., Los Angeles, CA (US) 90028

( * ) Notice: Subject to any disclaimer, the term of this patent is extended or adjusted under 35 U.S.C. 154(b) by 60 days.

(21) Appl. No.: 10/211,176

(22) Filed: Aug. 2, 2002

(65) Prior Publication Data

US 2004/0023177 A1 Feb. 5, 2004

(51) Int. Cl.
*F23D 3/28* (2006.01)

(52) U.S. Cl. ..... 431/2; 431/120; 219/227; 219/228; 219/229

(58) Field of Classification Search ..... 431/121, 431/122, 2; 126/401; 7/113; 401/1, 2; 228/20.5, 21; 219/227, 228, 229, 231
See application file for complete search history.

(56) References Cited

U.S. PATENT DOCUMENTS

| | | | | |
|---|---|---|---|---|
| 273,085 | A | 2/1883 | Houchin | |
| 517,180 | A | 3/1894 | Wilson | |
| 597,746 | A | 1/1898 | Schneider | |
| 625,354 | A * | 5/1899 | Putman | 219/240 |
| 641,648 | A * | 1/1900 | Rider | 222/113 |
| 658,591 | A | 9/1900 | Schiegel | |
| 954,483 | A | 4/1910 | Urbantsek | |
| 998,397 | A | 7/1911 | Rohsow et al. | |
| 1,016,209 | A | 1/1912 | Chenot | |
| 1,092,307 | A * | 4/1914 | Talbott et al. | 433/32 |
| 1,140,660 | A * | 5/1915 | Brizius | 433/32 |
| 1,189,735 | A * | 7/1916 | Quintin | 433/32 |
| 1,217,324 | A * | 2/1917 | Martin | 222/113 |
| 1,312,347 | A * | 8/1919 | Ogden | 401/2 |
| 1,905,987 | A * | 4/1933 | Lane | 219/236 |
| 1,966,374 | A | 7/1934 | Brandenburg | |
| 1,974,051 | A * | 9/1934 | Kelly | 425/281 |
| 2,111,645 | A * | 3/1938 | Slutzky et al. | 433/32 |
| 2,119,908 | A * | 6/1938 | Ellis | 219/229 |
| 2,146,979 | A * | 2/1939 | Paolicelli | 219/230 |

(Continued)

FOREIGN PATENT DOCUMENTS

| | | | | |
|---|---|---|---|---|
| DE | 910219 | * | 4/1954 | 219/227 |

(Continued)

OTHER PUBLICATIONS

Guillot Apothecary and Day Spa—Wickman Products; http://www.guillotapothecary.com/wickman.html.

*Primary Examiner*—Carl D. Price
(74) *Attorney, Agent, or Firm*—Sonnenschein Nath & Rosenthal LLP

(57) ABSTRACT

A device and method for exposing the ignitable end of a candle wick embedded in wax leaving an area around the wick to facilitate future lighting. The device includes an elongate hollow heated tube, heated by a heating source which heats the elongate hollow tube to a temperature sufficient to substantially soften or liquefy candle wax. A working end of the heated elongate hollow tube is inserted into the candle wax around the embedded ignitable end of a candle wick. The candle and the device are inverted and the wax around the candle wick flows through the interior of the heated elongate hollow tube and out a draining end of the heated elongate hollow tube thus exposing the embedded wick. The device also includes a handle allowing a user to easily hold and control the heated tube.

6 Claims, 3 Drawing Sheets

U.S. PATENT DOCUMENTS

| | | | | | |
|---|---|---|---|---|---|
| 2,167,420 | A | * | 7/1939 | Humphrey | 530/214 |
| 2,184,105 | A | * | 12/1939 | Steiner | 433/32 |
| 2,220,738 | A | | 11/1940 | Stoddard | |
| 2,351,568 | A | * | 6/1944 | Wheaton | 205/73 |
| 2,418,214 | A | * | 4/1947 | Yeager et al. | 433/32 |
| 2,453,525 | A | * | 11/1948 | McNeill | 30/123.3 |
| 2,454,576 | A | * | 11/1948 | Slack | 219/241 |
| 2,468,818 | A | * | 5/1949 | Fox et al. | 219/239 |
| 2,698,653 | A | | 1/1955 | Hollaway | |
| 2,955,187 | A | * | 10/1960 | Campo | 228/20.5 |
| 2,972,035 | A | | 2/1961 | Miller | |
| 3,024,343 | A | * | 3/1962 | Siwakoski | 228/20.5 |
| 3,110,304 | A | * | 11/1963 | Hartman | 600/200 |
| 3,299,838 | A | * | 1/1967 | Thietje | 425/279 |
| 3,364,577 | A | * | 1/1968 | Oakleaf et al. | 433/32 |
| 3,614,389 | A | * | 10/1971 | Malisza | 219/421 |
| 3,734,093 | A | * | 5/1973 | Paurice | 604/26 |
| 3,821,513 | A | * | 6/1974 | Christensen | 219/233 |
| 3,842,240 | A | * | 10/1974 | Wakita et al. | 219/230 |
| 3,902,043 | A | * | 8/1975 | Rogan | 219/242 |
| 4,074,110 | A | * | 2/1978 | Slaughter | 219/240 |
| 4,187,972 | A | * | 2/1980 | Vella | 228/20.5 |
| 4,432,715 | A | * | 2/1984 | Ghim | 425/87 |
| 4,793,352 | A | * | 12/1988 | Eichenlaub, John E. | 607/105 |
| 4,957,226 | A | * | 9/1990 | Pacia | 222/643 |
| 5,061,178 | A | * | 10/1991 | Ueno | 433/32 |
| 5,123,837 | A | | 6/1992 | Farnham et al. | |
| 5,537,989 | A | | 7/1996 | York, Jr. et al. | |
| 5,888,199 | A | * | 3/1999 | Karell et al. | 606/162 |
| 6,131,794 | A | * | 10/2000 | Burke et al. | 228/20.1 |
| 6,230,745 | B1 | * | 5/2001 | Brooks | 138/33 |
| 2003/0134245 | A1 | * | 7/2003 | Jones | 431/288 |

FOREIGN PATENT DOCUMENTS

| | | | | |
|---|---|---|---|---|
| EP | 0076735 | * | 4/1983 | 219/230 |
| JP | 62-197240 | * | 8/1987 | |
| JP | 09-108241 | * | 4/1997 | |

* cited by examiner

DEVICE AND METHOD FOR EXPOSING A CANDLE WICK EMBEDDED IN CANDLE WAX

BACKGROUND OF THE INVENTION

1. Field of the Invention

The present invention generally relates to a device and method for exposing the ignitable end of a candle wick of a used candle, thereby, making re-lighting easier and making the used candle look new and fresh.

2. Description of the Prior Art

Candles are, and have been, a popular part of the aesthetics of homes, apartments, hotel rooms, offices, bed and breakfasts and restaurants. These candles are sometimes contained in glass, metal or porcelain vessels and can be difficult to light in the best of circumstances. Large candles capable of burning for days are frequently lit, extinguished and relit. This process often leaves the ignitable end of the wick buried or embedded in reformed wax and, depending on the candle or the vessel in which the candle is contained, can make it difficult for a user to re-light. Candle wicks embedded in wax are also unattractive and uninviting. If the candle wick is entirely embedded in wax, the candle looks "used" and a bed and breakfast guest may forego the inconvenience of lighting the candle, thus missing some of the ambiance the innkeepers intended to create.

Lighters, matches and even lengthy fireplace matches in use today are limited in their ability to reach and re-light many candles. Candles found inside of ornamental vessels often require the person re-lighting the candle to turn the vessel upside down. This process is made more unsafe if that person must use a match or lighter to first melt the wax around the buried wick to expose the wick. Hot wax can drip on the user's hands or floor and exposed flames can cause vessels to crack or become covered in soot.

The present invention is an advancement over prior art that used an open flame and required the user to dig the candle wick out of the wax. Such methods posed a risk of injury to the user and created an unsightly and irregular area around the candle wick. Moreover, in the case of candles in which the top of the candle wick does not extend to the top of the hardened wax in which it is embedded, the prior art still left the candle wick submerged in liquid wax and did nothing to facilitate lighting the candle by the next user such as a hotel room occupant or waiter having only matches or a traditional lighter. The prior art required the user to swirl, tilt or agitate the candle to move the melted wax away from the short wick.

SUMMARY OF THE INVENTION

Briefly, the apparatus of this invention is a device for exposing the ignitable end of a candle wick embedded in candle wax of a candle. The device comprises an elongate hollow tubular member for melting candle wax, a heating source for heating the elongate hollow tubular member and a handle engaging the elongate hollow tubular member for manipulating the device.

The method of this invention is a method for extracting the ignitable end of a candle wick embedded in the candle wax of a candle using a device including an elongate hollow tube having a working end, a heating source and a handle. The method comprises heating the elongate hollow tubular member to a temperature sufficient to substantially soften or liquefy candle wax, positioning the working end of the elongate hollow tubular member proximate the embedded candle wick, inserting the working end of the elongate hollow tubular member in the candle wax, positioning the candle and/or the device so as to allow the candle wax to flow inside the elongate hollow tubular member away from the candle wick, and disengaging the device from the candle thereby revealing the exposed candle wick.

BRIEF DESCRIPTION OF THE DRAWINGS

Corresponding reference characters indicate corresponding parts throughout the several views of the drawings.

DETAILED DESCRIPTION OF PREFERRED EMBODIMENT

Figure 1:
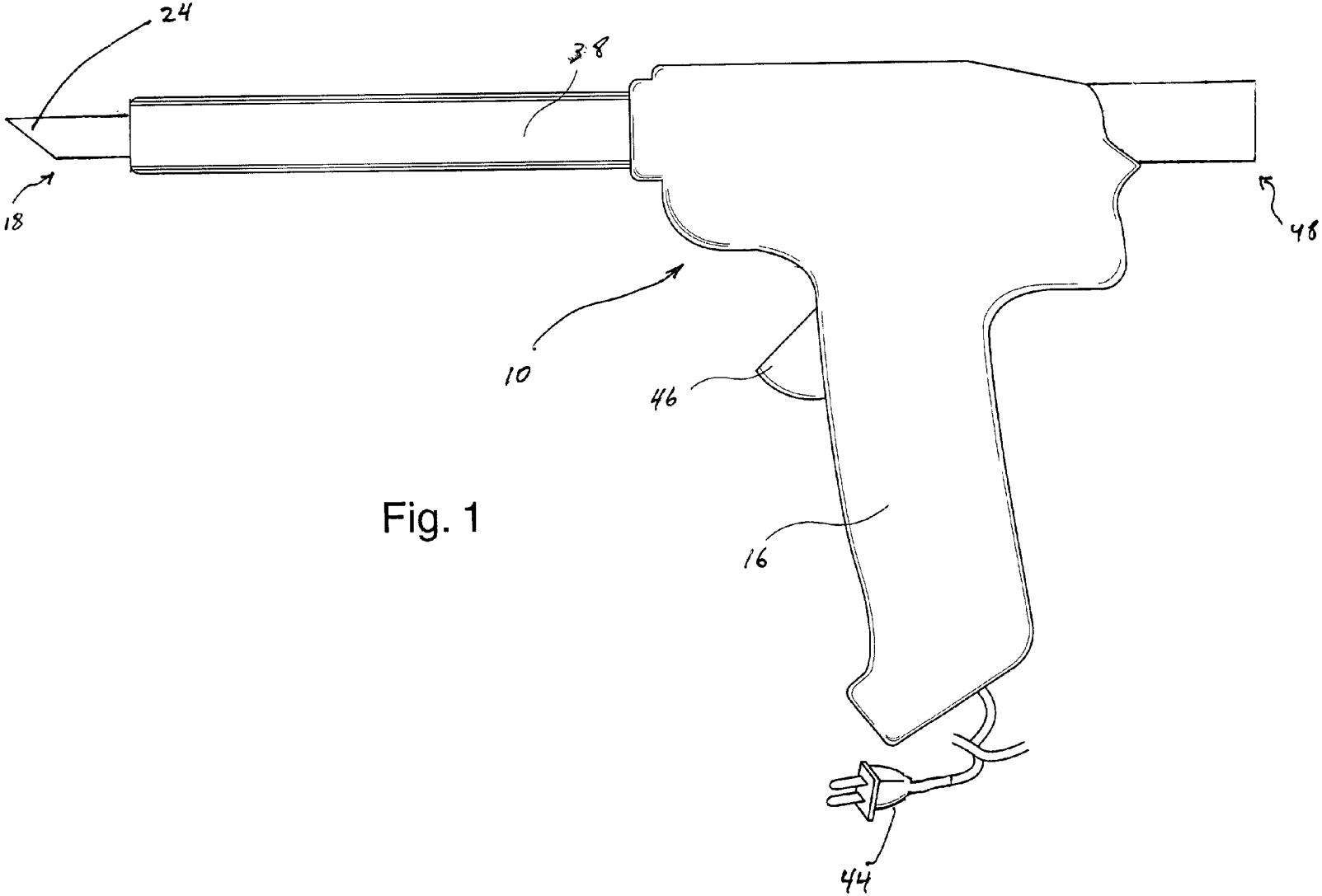
FIG. 1 is a side elevation of a first embodiment of the device of the present invention.
Figures 2, 3:
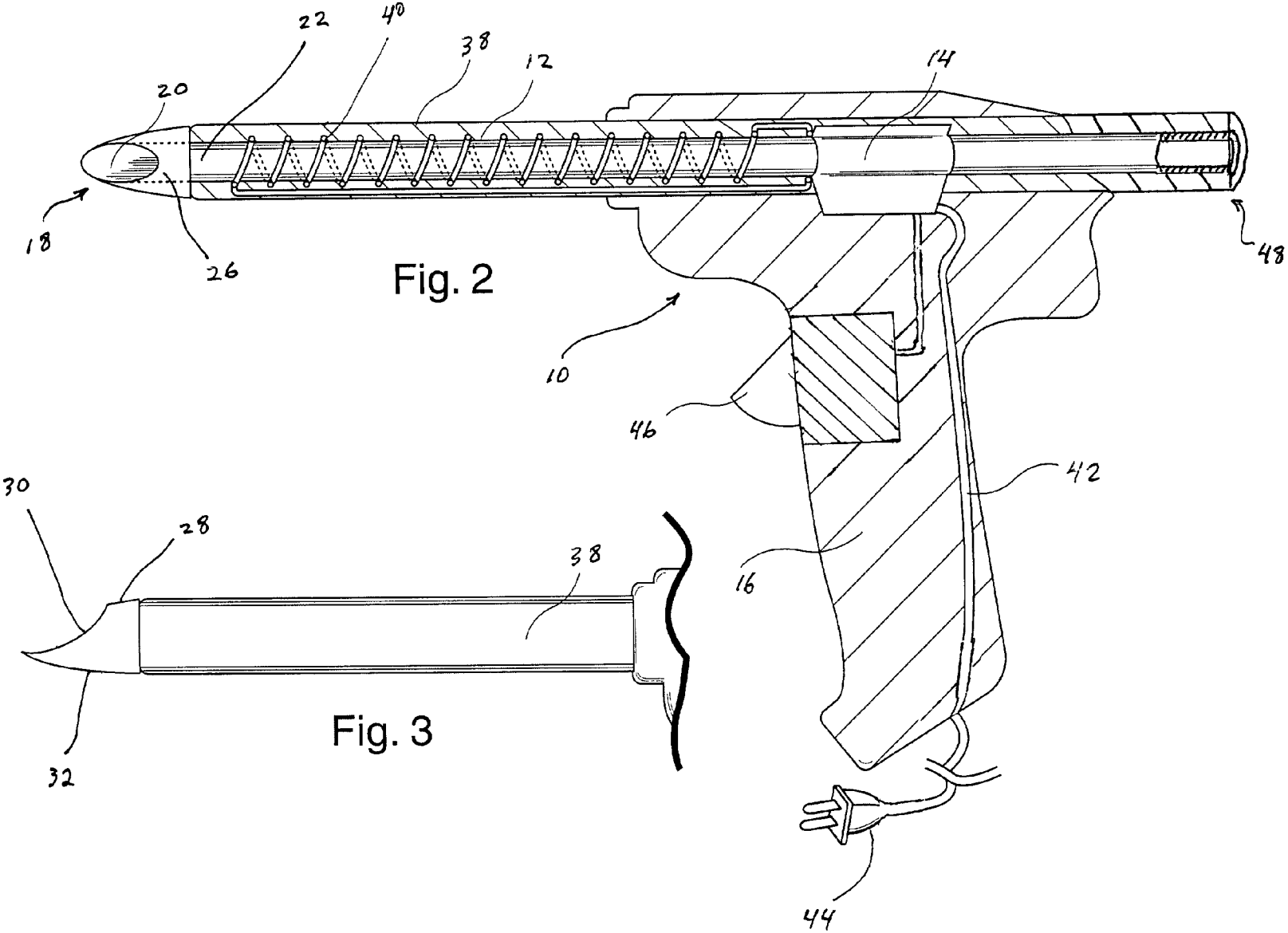
FIG. 2 is a sectional view of a second embodiment of the device of the present invention.
FIG. 3 is a partial side elevation of the second embodiment of the device of the present invention showing the tip of the device in an alternate position.
Figure 5B:
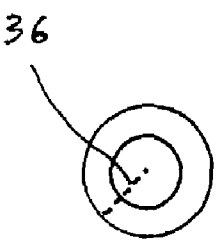
FIG. 5*b* is a front elevation of the tip of the second embodiment of the device of the present invention.
Figure 5A:
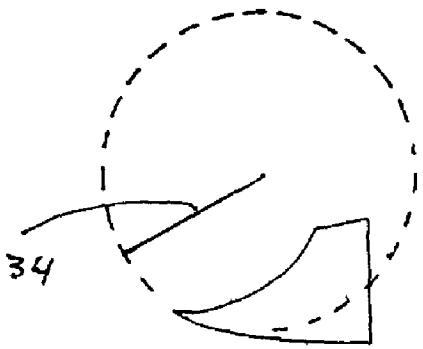
FIG. 5*a* is a side elevation of the tip of the second embodiment of the device of the present invention.

Referring to the drawings, and particularly to FIGS. 1 and 2, a device for exposing the ignitable end of a candle wick is designated in its entirety by the reference numeral 10. Generally, the device 10 includes an elongate hollow tube 12, a heating source 14 and a handle 16 as shown in FIG. 2. The elongate hollow tube 12 comprises a heat-conducting material such as, for example, copper or aluminum. To accommodate various candle and wick sizes, the elongate hollow tube 12 has a round cross-section with an outside diameter of between about 4.8 millimeters and about 17.5 millimeters and an inside diameter of between about 3.2 millimeters and 9.5 millimeters. Preferably, the elongate hollow tube 12 has an outside diameter of about 9.5 millimeters and an inside diameter of about 6.4 millimeters. The elongate hollow tube 12 includes a working end 18 having an entrance 20 leading to a circular throat or passage 22 extending through the elongate hollow tube 12. The working end 18 includes a tip. In the embodiment shown in FIG. 1, the tip 24 is formed as a sharp penetrating tool by forming the working end 18 at an angle with respect to a longitudinal axis of the elongate hollow tube 12. The tip 24 of this embodiment allows the device 10 to penetrate and find purchase in the hardened wax and allows the device 10 to remain stable during the melting process, thus creating a clean depression in the candle. In a second embodiment as shown in FIGS. 2, 3, 5*a* and 5*b*, the tip 26 is formed in a scooping or carving shape. In this embodiment, the tip 26 allows the user to carve out a depression or crater of various size in the candle. A tip 26 formed in a scooping or carving shape in accordance with this second embodiment includes an upper carving surface 28 having an opening 30 and a lower convex carving surface 32 opposite the upper carving surface. The lower convex carving surface 32 generally has a convex shape defined by a longitudinal curvature radius 34 and a transverse curvature radius 36, lying in orthogonal longitudinal and transverse planes, respectively, as shown in FIGS. 5*a* and 5*b*. To accommodate a variety of candle and wick sizes, the longitudinal curvature radius 34 is between about 12.7 millimeters and about 127 millimeters and the transverse curvature radius 36 is between about 6.4 millimeters and about 25.4 millimeters. Preferably, the longitudinal curvature radius 34 is about 19.1 millimeters and the transverse curvature radius 36 is about 12.7 millimeters. In an alternate embodiment (not shown), the tip 26 can be adapted to slide and mount on tip 24 to allow the user to switch between a penetrating and a carving function of the device 10. In yet another embodiment (not shown), the tip 26 can be mounted to allow it to rotate on the tip 24 or on the elongate hollow tube 12 to allow for a greater variety of carving techniques. An exterior sheathing 38 made of a heat-resistant material covers a substantial portion of the elongate hollow tube 12. For proper heat insulation, the thickness of the exterior sheathing 38 is between around 3.2 millimeters and about 9.5 millimeters. Preferably, the thickness of the exterior sheathing 38 is about 6.4 millimeters.

The handle 16 attaches to the elongate hollow tube 12 by any number of conventional means such as, for example, clamping, bolting with fasteners or soldering. The handle 16 is made from a heat-resistant material such as polycarbonate or porcelain that will not conduct heat or electric current to the user. The handle 16 fits easily into the user's hand and, in one preferred embodiment, has generally a pistol grip shape as illustrated in FIG. 1. The handle 16 can also be round or tubular to fit outside, over or adjacent to the elongate hollow tube 12 to be held like a pencil or a knife. The handle 16 can also be covered in a rubber or plastic coating for enhanced ease of use.

As further illustrated in FIG. 2, a heating source 14 is attached to the handle 16 and includes a heating coil 40 for heating the entire length of the elongate hollow tube 12 to a temperature sufficient to substantially soften or liquefy candle wax. To accommodate the wide variety of candle wax types, the elongate hollow tube 12 is heated to a temperature between about 38° C. and about 650° C. Preferably, the elongate hollow tube 12 is heated to about 177° C. The heating source 14 may alternatively include a mesh or other conventional heating element for heating the entire length of the elongate hollow tube 12.

An electrical lead 42 and a connector 44 supply power to the heating source 14. Alternatively, the heating source 14 may be powered by one or more batteries (not shown) that may be concealed, for example, in a compartment in the handle 16.

In one embodiment, the user controls the heating of the elongate hollow tube with a controller such as, for example, a trigger switch 46 positioned on the handle of the device 10 as illustrated in FIG. 2. The controller may have either two positions, corresponding to turning the heating source 14 "on" and "off," or may alternatively have more than two positions, corresponding to varying the heating power of the heating source 14.

Figure 4:
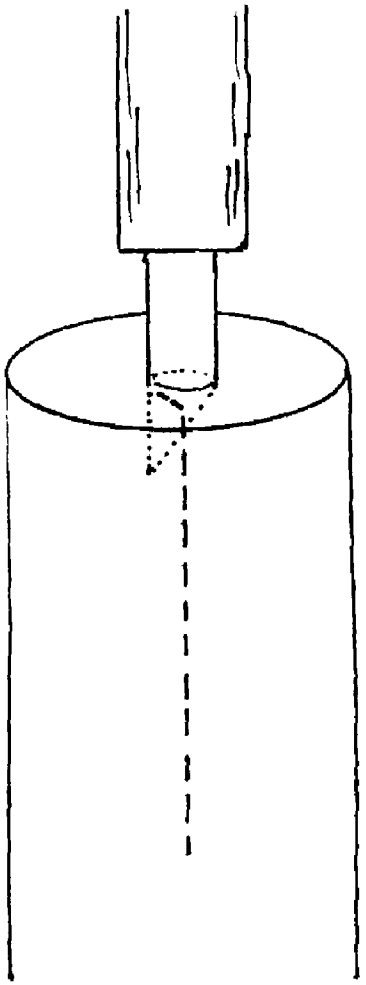
FIG. 4 is a partial side elevation of the working end of the device of the first embodiment inserted in a candle.

To expose the ignitable end of a candle wick embedded in the candle wax of a candle, the user activates the heating source 14 to heat the elongate hollow tube 12 to a temperature sufficient to substantially soften or liquefy candle wax. The user then positions the elongate hollow tube 12 with the working end 18 adjacent to the embedded candle wick as illustrated in FIG. 4. After positioning the working end 18 of the heated elongate hollow tube 12 in the wax generally around the embedded wick, the user inverts the device and the candle to facilitate the flow of the substantially softened or liquefied candle wax into the interior of the heated elongate hollow tube 12. Alternatively, either the device 10, the candle or both are moved in the vertical plane to cause the substantially softened or liquefied candle wax to flow inside the heated elongate hollow tube 12 away from the candle wick. The draining end 48 of the elongate hollow tube located at the end opposite the working end 18, allows the substantially softened or liquefied wax cleared from around the ignitable end of the candle wick to flow onto waste paper, a wastebasket or other receptacle.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description, or shown in the accompanying drawings, shall be interpreted as illustrative and not in a limiting sense.

We claim:

1. A method for extracting the ignitable end of a candle wick embedded in the candle wax of a candle using a device including an elongate hollow tube having a working end, a heating source and a draining end that is free of a vacuum source and operated substantially at an ambient atmospheric pressure, said method comprising:

(a) heating a working end of said elongate hollow tube to a temperature sufficient to substantially soften candle wax;

(b) positioning said working end of said elongate hollow tube proximate the embedded candle wick;

(c) inserting said heated working end of said elongate hollow tube in the candle wax;

(d) positioning at least one of said candle and said device so as to allow said candle wax to flow inside said elongate hollow tube and away from said candle wick thereby exposing the candle wick without imposing a vacuum thereon; and (e) disengaging said device from said candle thereby revealing the exposed candle wick.

2. A method according to claim 1 further comprising using said device to carve out a crater in the candle wax.

3. A method according to claim 1 wherein said elongate hollow tube is heated to a temperature between about 38° C. and about 650° C.

4. A method according to claim 3 wherein said elongate hollow tube is heated to a temperature of about 177° C.

5. A method according to claim 1 wherein said draining end is located opposite said working end, said method further comprising positioning at least one of said candle and said device so as to allow said candle wax to flow inside said elongate hollow tube from said working end to said draining end.

6. A method according to claim 5 further comprising positioning at least one of said device so as to allow said candle wax to drain out of said draining end.

* * * * *